US007771166B2

(12) United States Patent
Heine et al.

(10) Patent No.: US 7,771,166 B2
(45) Date of Patent: Aug. 10, 2010

(54) WELDED TURBINE SHAFT AND METHOD FOR PRODUCING SAID SHAFT

(75) Inventors: Werner-Holger Heine, Wesel (DE); Norbert Thamm, Essen (DE); Kai Wieghardt, Bochum (DE); Uwe Zander, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 768 days.

(21) Appl. No.: 10/593,043

(22) PCT Filed: Mar. 10, 2005

(86) PCT No.: PCT/EP2005/002558

§ 371 (c)(1),
(2), (4) Date: Sep. 15, 2006

(87) PCT Pub. No.: WO2005/093218

PCT Pub. Date: Oct. 6, 2005

(65) Prior Publication Data

US 2008/0159849 A1 Jul. 3, 2008

(30) Foreign Application Priority Data

Mar. 17, 2004 (EP) ..... 04006394

(51) Int. Cl.
*F01D 25/00* (2006.01)

(52) U.S. Cl. ..... 415/216.1

(58) Field of Classification Search ..... 415/216.1
See application file for complete search history.

(56) References Cited

U.S. PATENT DOCUMENTS

| | | | | |
|---|---|---|---|---|
| 3,876,335 | A * | 4/1975 | Forcinal et al. | 416/198 R |
| 4,962,586 | A * | 10/1990 | Clark et al. | 29/889.2 |
| 6,129,514 | A * | 10/2000 | Shiga et al. | 415/200 |
| 6,152,697 | A * | 11/2000 | Konishi et al. | 416/213 R |
| 6,358,004 | B1 * | 3/2002 | Shiga et al. | 415/200 |
| 6,499,946 | B1 * | 12/2002 | Yamada et al. | 415/199.4 |
| 6,767,649 | B2 * | 7/2004 | Staubli et al. | 428/553 |
| 6,962,483 | B2 * | 11/2005 | Ganesh et al. | 415/200 |
| 6,971,850 | B2 * | 12/2005 | Ganesh et al. | 415/216.1 |
| 7,065,872 | B2 * | 6/2006 | Ganesh et al. | 29/889.2 |
| 7,168,916 | B2 * | 1/2007 | Scarlin | 415/199.5 |
| 2002/0136659 | A1 | 9/2002 | Staubli et al. | |

FOREIGN PATENT DOCUMENTS

| | | | |
|---|---|---|---|
| DE | 101 14 612 | A1 | 9/2002 |
| EP | 0 964 135 | A2 | 12/1999 |
| JP | 57176305 | A | 10/1982 |

OTHER PUBLICATIONS

Ryotaro Magoshi, Takashi Nakano, Tetsu Konishi, Takashi Shige and Yoshiyuki Kondo, "Development and Operating Experience of Welded Rotors for High-temperature Steam Turbines", Proceedings of 2000 International Joint Power Generation Conference, Miami Beach, Florida, Jul. 23-26, 2000, pp. 1-6, XP-002298811.

* cited by examiner

*Primary Examiner*—Edward Look
*Assistant Examiner*—Aaron R Eastman

(57) ABSTRACT

The invention relates to a turbine shaft that is aligned in a longitudinal direction. Said shaft comprises a central region and two outer regions, which are fixed to the central region in the longitudinal direction. The central region is produced from a material with a higher heat resistance than the two outer regions.

11 Claims, 2 Drawing Sheets

WELDED TURBINE SHAFT AND METHOD FOR PRODUCING SAID SHAFT

CROSS REFERENCE TO RELATED APPLICATIONS

This application is the US National Stage of International Application No. PCT/EP2005/002558, filed Mar. 10, 2005 and claims the benefit thereof. The International Application claims the benefits of European Patent application No. 04006394.3 filed Mar. 17, 2004. All of the applications are incorporated by reference herein in their entirety.

FIELD OF THE INVENTION

The invention relates to a turbine shaft oriented in a longitudinal direction, with a middle region and with two outer regions fastened to the middle region in the longitudinal direction. The invention also relates to a method for producing a turbine shaft.

BACKGROUND OF THE INVENTION

A steam turbine is understood in the context of the present application to mean any turbine or subturbine through which a working medium in the form of steam flows. In contrast to this, the working medium flowing through gas turbines is gas and/or air which, however, is subject to completely different temperature and pressure conditions from the steam in a steam turbine. In contrast to gas turbines, in steam turbines, for example, the working medium flowing into a subturbine has the highest temperature and at the same time the highest pressure.

A steam turbine conventionally comprises a rotatably mounted turbine shaft which is equipped with blades and which is arranged within a casing jacket. When heated and pressurized steam flows through the flow space interior formed by the casing jacket, the turbine shaft is set in rotation via the blade by the steam. The blades of the turbine shaft are also designated as moving blades. Furthermore, stationary guide vanes are suspended on the casing jacket in a conventional way and engage into the interspaces of the moving blades. A guide vane is conventionally held at a first point along an inside of the steam turbine casing. It is in this case conventionally part of a guide vane ring comprising a number of guide vanes which are arranged along an inner circumference on the inside of the steam turbine casing. Each guide vane in this case points with its blade leaf radially inward.

Steam turbines or steam subturbines may be divided into high-pressure, medium-pressure or low-pressure subturbines. Where high-pressure subturbines are concerned, the inlet temperatures and inlet pressures may amount to a maximum of 700° C. and 300 bar respectively, depending on the material used. A sharp separation between high-pressure, medium-pressure or low-pressure subturbines has hitherto not been defined uniformly among experts.

According to DIN standard 4304, a medium-pressure subturbine is obtained when this medium-pressure subturbine is preceded by a high-pressure subturbine into which fresh steam flows, and when the outflowing steam from the high-pressure subturbine is intermediately superheated in an intermediate superheater and flows into the medium-pressure subturbine. According to the standard DIN 4304, a low-pressure subturbine is defined as a turbine which receives the expanded steam from a medium-pressure subturbine as fresh steam.

Single-casing steam turbines are known which constitute a combination of a high-pressure and of a medium-pressure steam turbine. These steam turbines are characterized by a common casing and a common turbine shaft and are also designated as compact subturbines.

Compact subturbines are designed with forms of construction which are designated by reverse-flow or by straight-flow. In the straight-flow form of construction, the fresh steam flows into the steam turbine and spreads essentially in the axial direction of the steam turbine through the high-pressure subturbine, is then recirculated to the intermediate superheater unit into the boiler and passes from there into the medium-pressure subturbine.

In the reverse-flow form of construction, the fresh steam flows through the outer casing and there impinges essentially onto the middle of the turbine shaft and subsequently flows through the high-pressure subturbine. The expanded steam flowing out downstream of the high-pressure subturbine is intermediately superheated in an intermediate superheater and flows into the steam turbine again at a suitable point upstream of the medium-pressure subturbine. The flow directions of the steam in the high-pressure subturbine and in the medium-pressure subturbine are in this case opposite to one another.

The turbine shaft must meet particular requirements on account of the various temperatures of the steam. Heat-resistant properties are demanded in the inflow region of the high-pressure subturbine. High long-time rupture strengths under centrifugal force are required at the ends of the turbine shaft. Furthermore, good toughness properties and tensile strengths are desired.

Monobloc turbine shafts consisting of one material have been used hitherto in compact subturbines. Particularly for high power outputs, the production of these monobloc turbine shafts signifies a costly solution. A further disadvantage of these monobloc turbine shafts is that relatively costly build-up welds have to be applied at the bearing points.

SUMMARY OF THE INVENTION

The object of the present invention is to specify a turbine shaft which is particularly suitable for use in compact subturbines. A further object of the invention is to specify a method for the production of a turbine shaft which is suitable for compact subturbines.

The object aimed at the turbine shaft is achieved by means of a turbine shaft oriented in a longitudinal direction, with a middle region and with two outer regions fastened to the middle region in the longitudinal direction, the middle region being produced from a more highly heat-resistant material than the two outer regions.

The invention is based on the recognition that a change of material is necessary above specific fresh steam inlet temperatures of, for example, above 565° C., for specific turbine shaft diameters and beyond certain rotational speeds, for example 50 or 60 Hz. The reason for this is predominantly an increasing long-time depletion under centrifugal force. A turbine shaft consisting of three regions in a longitudinal direction affords the possibility of being able to use materials having different properties. A turbine shaft produced from three regions is much more beneficial, as compared with a monobloc turbine shaft having the same required properties.

In addition, a turbine shaft produced from three regions, that is to say a turbine shaft produced from three discrete blocs, is superior in terms of material to a monobloc turbine shaft and is coordinated optimally with the particular cold-resistant and heat-resistant properties.

In an advantageous development, the two outer regions are connected to one another at the middle region in each case by means of a weld. This affords a relatively favorable solution for producing a compact turbine shaft for a compact subturbine.

The middle region is in this case produced from a forging steel having 9 to 12% by weight of chromium and the two outer regions are produced from steels having 1 to 2% by weight of chromium. By a forging steel having 9 to 12% by weight of chromium and a steel having 1 to 2% by weight of chromium being combined, the problem of increasing long-time depletion under centrifugal force, occurring above specific parameters, such as, for example, high steam temperatures of more than 565° C., large rotor diameters and high rotational speeds, for example 60 Hz, is solved.

In a further advantageous development, the middle region may be produced from a forging steel having 10% by weight of chromium and the two outer regions from steels having 2% by weight of chromium. The two outer regions can be produced from different materials in exactly the same way. This affords the possibility of using a suitable material for a respective area of use.

BRIEF DESCRIPTION OF THE DRAWINGS

Exemplary embodiments of the invention are described by means of the description and the figures. In these, components with the same reference symbols have the same functioning.

In detail, in the figures of the drawings.

DETAILED DESCRIPTION OF THE INVENTION

Figure 1:
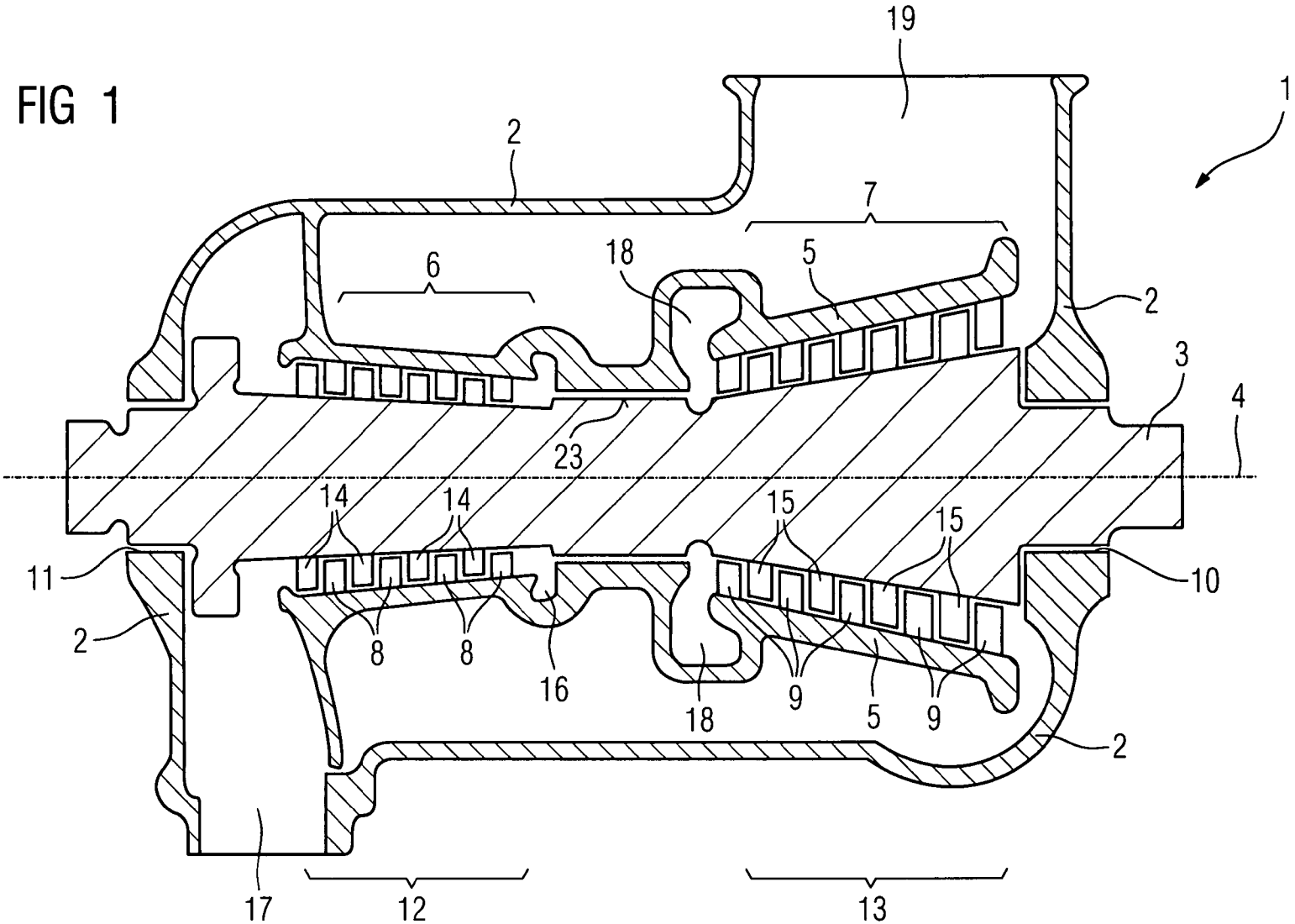
FIG. 1 shows a sectional diagram through a compact subturbine.

FIG. 1 illustrates a sectional diagram of a compact steam turbine 1. The compact subturbine 1 has an outer casing 2 in which a turbine shaft 3 is mounted rotatably about the axis of rotation 4. The compact steam turbine 1 has an inner casing 5 with a high-pressure part 6 and with a medium-pressure part 7. Various guide vanes 8 are mounted in the high-pressure part 6.

A number of guide vanes 9 are likewise mounted in the medium-pressure part 7. The turbine shaft 3 is mounted rotatably by means of bearings 10, 11.

The inner casing 5 is connected to the outer casing 2.

The steam turbine 1 has a high-pressure part 12 and a medium-pressure part 13. Moving blades 14 are mounted in the high-pressure part 12. Moving blades 15 are likewise mounted in the medium-pressure part.

Fresh steam with temperatures of more than 550° C. and a pressure of above 250 bar flows into the inflow region 16. The fresh steam may also have other temperatures and pressures. The fresh steam flows through the individual guide vanes 8 and moving blades 14 in the high-pressure part 12 and is at the same time expanded and cools. In this case, the thermal energy of the fresh steam is converted into rotational energy of the turbine shaft 3. The turbine shaft 3 is thereby set in rotation in a direction illustrated about the axis of rotation 4.

After flowing through the high-pressure part 6, the steam flows out of an outflow region 17 into an intermediate superheater, not illustrated in any more detail, and is brought to a higher temperature there. This heated steam is subsequently introduced via lines, not illustrated in any more detail, into a medium-pressure inflow region 18 and into the compact steam turbine 1. The intermediately superheated steam in this case flows through the moving blades 15 and guide vanes 9 and is thereby expanded and cools. The conversion of the kinetic energy of the intermediately superheated steam into a rotational energy of the turbine shaft 3 brings about a rotation of the turbine shaft 3. The expanded steam flowing out in the medium-pressure part 7 flows out of an outflow region 19 from the compact steam turbine 1. This outflowing expanded steam can be used in low-pressure subturbines, not illustrated in any more detail.

Figure 2:
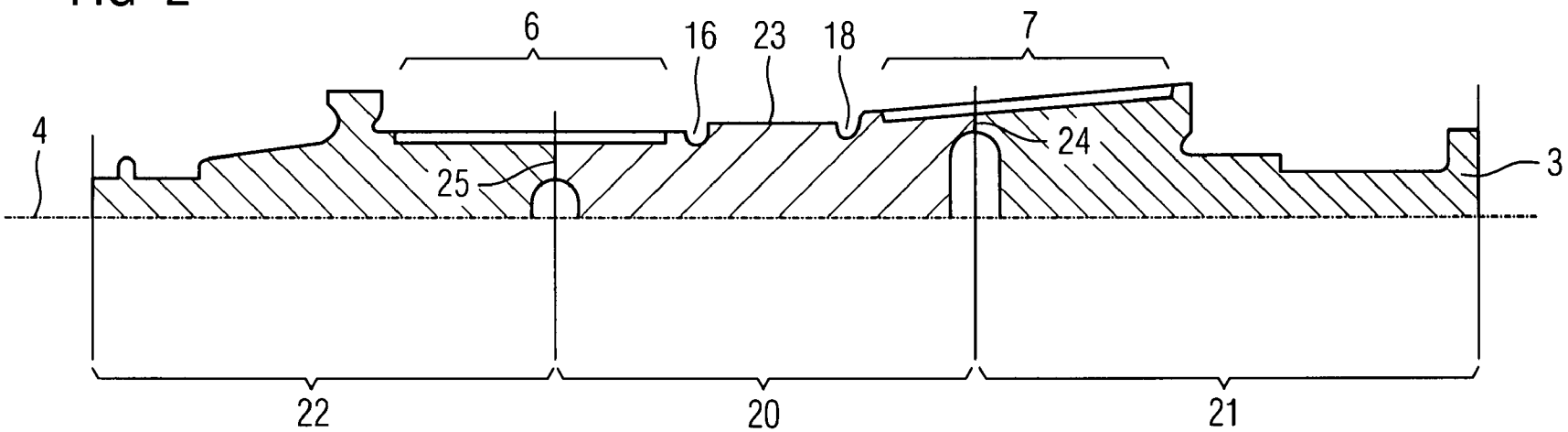
FIG. 2 shows a sectional diagram through part of a turbine shaft of a compact subturbine.

FIG. 2 illustrates a section through part of the turbine shaft 3. The turbine shaft 3 consists of a middle region 20 and of two outer regions 21 and 22.

The turbine shaft 3 is mounted in the bearing region 23 with the outer casing 5.

The moving blades 14, 15 are not illustrated in any more detail. The fresh steam first impinges on the middle region 20 of the turbine shaft 3 and expands in the high-pressure part 6. The fresh steam at the same time cools. Downstream of an intermediate superheater unit, the steam flows at a high temperature into the middle region 20 again. The intermediately superheated steam first flows onto the turbine shaft 3 at the location of the medium-pressure inflow region 18 and expands and cools in the direction of the medium-pressure part 7. The steam expanded and cooled in the medium-pressure part 7 then subsequently flows out of the compact subturbine 1.

The middle region 20 of the turbine shaft has a highly heat-resistant material. The highly heat-resistant material is a forging steel having 9 to 12% by weight chromium fraction. In alternative embodiments, the middle region may also consist of materials based on nickel. In this case, the two outer regions 21 and 22 should consist of 10 to 12% by weight chromium fraction.

The two outer regions 21 and 22 consist of a less highly heat-resistant material than the middle region 20. The two outer regions 21 and 22 may be produced from steels having 1 to 2% by weight of chromium, or essentially 3.5% by weight of nickel. For example, the middle region 20 of the turbine shaft may be a forging steel having 9 to 12% by weight chromium fraction, with the two outer regions 21 and 22 being produced from steels having essentially 3.5% by weight of nickel.

The two outer regions 21 and 22 do not have to be produced from the same material. Instead, it is expedient to produce the two outer regions 21 and 22 from different materials.

The middle region 20 and the outer region 21 are connected to one another by means of a weld 24. The middle region 20 is likewise connected to the outer region 22 via a further weld 25. The turbine shaft 3 is in this case formed in a longitudinal direction which is identical to the axis of rotation 4.

If the middle region 20 is produced from a material based on nickel, the outer regions may be produced from a steel having 9 to 12% by weight of chromium.

The turbine shaft 3 is produced as described below. The middle region 20 is produced from a single bloc of heat-resistant material. One outer region 21 is produced from another single bloc of less heat-resistant material than that of the middle region 20. The second outer region 22 is likewise produced from yet another single bloc of less heat-resistant material than that of the middle region 20. The middle region 20 is subsequently welded to the two outer regions 21, 22.

The invention claimed is:

1. A turbine rotor shaft, comprising:

a middle region consisting of a middle bloc, having a middle region material and a longitudinal axis and having a first end face oriented perpendicular to the longitudinal axis and arranged at a first end of the middle region and a second end face arranged at a second end of the middle region opposite the first end face;

a first outer region consisting of a first bloc, having a first material and arranged coaxially with the longitudinal axis abutting the first end face of the middle region, comprising a first bearing surface configured to receive a first bearing which mounts the first outer region to the turbine, wherein when disposed in a steam turbine the first outer region abuts the first end face of the middle region upstream of a last row of blades and downstream of a first row of blades within a high pressure part of the steam turbine; and a second outer region consisting of a second bloc, having a second material and arranged coaxially with the longitudinal axis and abutting the second end face of the middle region, comprising a second bearing surface configured to receive a second bearing which mounts the second outer region to the turbine, wherein the middle region material has a higher heat resistance than the first and second materials.

2. The turbine shaft as claimed in claim 1, wherein the first and second outer regions are welded to the middle region.

3. The turbine shaft as claimed in claim 2, wherein the middle region material is a forging steel having 9 to 12% by weight of chromium and the first and second materials are steels having 1 to 2% by weight of chromium.

4. The turbine shaft as claimed in claim 3, wherein the first and second outer region materials are different.

5. The turbine shaft as claimed in claim 4, wherein the middle region is exposed to steam at 565° C. and 250 bar.

6. The turbine shaft as claimed in claim 1, wherein the middle region material is nickel based.

7. The turbine shaft as claimed in claim 6, wherein the first and second materials are steels having 9 to 12% by weight chromium fraction.

8. The turbine shaft as claimed in claim 6, wherein the first and second materials are steels having approximately 3.5% by weight of nickel.

9. The turbine shaft as claimed in claim 1, wherein the middle region material is a forging steel having 9 to 12% by weight of chromium and the first and second materials are steels having 3.5% by weight of nickel.

10. A method for manufacturing a turbine shaft, comprising:

producing a first outer region from a first bloc of a material that is less heat-resistant than a middle region material, the first outer region comprising a first bearing surface configured to receive a first bearing which mounts the first outer region to a turbine, and further configured to, when disposed in a steam turbine, abut the middle region upstream of a last row of blades and downstream of a first row of blades within a high pressure part of the steam turbine;

producing a second outer region from a second bloc of a material that is less heat-resistant than the middle region material, the second outer region comprising a second bearing surface configured to receive a second bearing which mounts the second outer region to the turbine; and welding the first and second outer regions to opposite ends of the middle region.

11. A steam turbine, comprising:

a turbine shaft arranged coaxial with a rotational axis of the turbine wherein the shaft has a middle region consisting of a middle bloc, having a middle region material and first and second end faces oriented perpendicular to the longitudinal axis of the shaft arranged at opposite ends of the middle region, a first outer region consisting of a first bloc, the first outer region comprising a first bearing surface configured to receive a first bearing which mounts the first outer region to a turbine, wherein when disposed in a steam turbine the first outer region abuts the first end face of the middle region upstream of a last row of blades and downstream of a first row of blades within a high pressure part of the steam turbine, the first outer region having a first material and arranged coaxially with the longitudinal axis abutting the first end face of the middle region, and a second outer region consisting of a second bloc, the second outer region comprising a second bearing surface configured to receive a second bearing which mounts the second outer region to the turbine, the second outer region having a second material and arranged coaxially with the longitudinal axis and abutting the second end face of the middle region wherein the middle region material has a higher heat resistance than the first and second materials;

a plurality of blades attached to the first outer and second outer regions of the turbine shaft;

an inner casing surrounding the turbine shaft;

a plurality of vanes attached to an inner surface of the inner casing; and an outer casing that surrounds the inner casing.

* * * * *